US010364559B2

(12) United States Patent
Armstrong

(10) Patent No.: US 10,364,559 B2
(45) Date of Patent: Jul. 30, 2019

(54) PLUMBING DEVICE

(71) Applicant: Russell Winston Armstrong, Derbyshire (GB)

(72) Inventor: Russell Winston Armstrong, Derbyshire (GB)

( * ) Notice: Subject to any disclaimer, the term of this patent is extended or adjusted under 35 U.S.C. 154(b) by 0 days.

(21) Appl. No.: 15/223,981

(22) Filed: Jul. 29, 2016

(65) Prior Publication Data

US 2016/0333559 A1 Nov. 17, 2016

Related U.S. Application Data

(63) Continuation-in-part of application No. PCT/GB2015/050219, filed on Jan. 30, 2015.

(51) Int. Cl.
*E03C 1/298* (2006.01)

(52) U.S. Cl.
CPC ..... *E03C 1/298* (2013.01)

(58) Field of Classification Search
CPC ..... E03C 1/298; F16K 15/063
USPC ..... 137/540–542
See application file for complete search history.

(56) References Cited

U.S. PATENT DOCUMENTS 1,260,663 A * 3/1918 Gould ..... F16K 15/063 137/541
2,182,278 A * 12/1939 Brauer ..... E21B 21/10 137/533.29
4,582,081 A 4/1986 Fillman
4,918,940 A 4/1990 Buckley
(Continued)

FOREIGN PATENT DOCUMENTS

DE 29717363 U1 11/1997
DE 19835714 A1 2/2000
(Continued)

OTHER PUBLICATIONS

European Search Report date of Completion of Search Dec. 15, 2016 for Application No. 16182821.
(Continued)

*Primary Examiner* — P. Macade Nichols
(74) *Attorney, Agent, or Firm* — Moser Taboada

(57) ABSTRACT

The invention provides a connector having:

a. a chamber having an open upper chamber and a lower chamber,
b. an inlet connector and
c. an outlet connector formed in a floor of the lower chamber.

The inlet connector is supported above the open upper chamber by one or more arms. The upper chamber has an upper chamber floor having an upper chamber outlet, the upper chamber being in fluid communication with the lower chamber by means of the upper chamber outlet. The upper chamber outlet has a non-return valve which is arranged to open at a pre-selected pressure and the lower chamber forms a flow conduit for receiving the valve when it is open. In some embodiments a shielded connector is provided in which a shield is shaped to cover the open upper chamber of the connector. A valve assembly may be provided for use in the connector or shielded connector wherein the valve assembly has a stem, a biasing member for biasing the valve assembly into a closed position, a valve disc for sealing the outlet. An upper washer and a lower washer are disclosed for support of the valve disc such that the valve disc does not distort in use.

22 Claims, 11 Drawing Sheets

(56) References Cited

U.S. PATENT DOCUMENTS

| | | | |
|---|---|---|---|
| 5,613,518 | A | 3/1997 | Rakieski |
| 2011/0132474 | A1 | 6/2011 | Reese et al. |
| 2016/0333559 | A1 | 11/2016 | Armstrong |

FOREIGN PATENT DOCUMENTS

| | | | |
|---|---|---|---|
| DE | 202005002415 | U1 | 4/2005 |
| DE | 202012103132 | U1 | 11/2013 |
| EP | 3128087 | A2 | 2/2017 |
| EP | 3222982 | A1 | 9/2017 |
| GB | 2366830 | A | 3/2002 |
| GB | 2478124 | A | 8/2011 |
| GB | 2522634 | A | 8/2015 |
| JP | S5563071 | A | 5/1980 |
| WO | WO-0218824 | A1 | 3/2002 |

OTHER PUBLICATIONS

International Search Report dated Apr. 8, 2015 for PCT/GB2015/050219.
GB Search Report dated Jul. 7, 2014 for GB1401557.2.

* cited by examiner

PLUMBING DEVICE

CROSS-REFERENCE TO RELATED APPLICATIONS

This application is a continuation-in-part of the PCT Application No. PCT/GB2015/050219 filed on Jan. 30, 2015, which claims priority to and the benefit of GB Application No. 1401557.2, filed on Jan. 30, 2014, and further claims the priority to and the benefit of GB Application No. 1513876.1, filed Aug. 5, 2015 and GB Application No. 1522290.4, filed Dec. 17, 2015, and the disclosures of each of the applications above is incorporated herein by reference in its entirety.

BACKGROUND

Field of the Invention

The present invention relates to a plumbing device which allows a pressure and/or temperature relief valve for a fresh water system to be connected to a waste pipe or soil stack without the risk of back contamination or odours.

An example of the use of a relief valve is with an unvented domestic hot water storage system (UVHWSS) or unvented hot water heater (UVHWH). Such a system typically has a temperature and/or pressure relief valve connected to a discharge pipe. The regulations for connection of the discharge pipe to a waste water system are strict because of the risk of back contamination from the pathogenic water in the waste water system to the fresh water in the storage system. Typically, the regulations require a tundish to provide a visible point of discharge and an air gap (to provide backflow prevention) and the outflow from the tundish to be connected in a particular way to discharge above an external ground floor gulley. Such a connection requires careful engineering and is expensive to install.

In order to connect the vent valve to a soil stack within a building, arrangements need to be made to provide an odour trap to prevent any foul gases from the soil stack from entering the domestic location. On most domestic installations, a water trap would be used to prevent escape of gases and odours from the soil stack. Typically, a water trap comprises a bended tube in which water is trapped. A water trap allows passage of liquid and suspended solids but not gases. Generally speaking, a water trap is not suitable for use with a tundish as it will become ineffective through drying out. A water trap is also relatively bulky and is not suitable for use in all locations.

More recently, a product has been approved which provides an odour trap which allows the discharge pipe to be connected to a soil stack within a building. This product is designed to be used in association with a tundish and is not easy to use with an UVHWH because of its overall length.

A way of ameliorating these problems has been sought.

SUMMARY

According to the invention, there is provided a connector which connector comprises a chamber having an open upper chamber and a lower closable chamber, an inlet connector, an outlet connector formed in a floor of the lower chamber wherein the inlet connector is supported above the open upper chamber by one or more arms and wherein the lower chamber is closable by a non-return valve which is arranged to open at a pre-selected pressure.

In some embodiments, the pre-selected pressure is a pressure applied by a flow of liquid from the inlet such as may be produced by a pressure and/or temperature relief valve in operation. For example, the pre-selected pressure may be sufficiently high to prevent accidental opening of the non-return valve (for example due to dust or condensation on the valve) but not so high to restrict flow of liquid from the inlet such that liquid overflows from the open upper chamber. A skilled person would be able to determine a suitable pressure.

In some embodiments, the chamber has a tubular middle chamber arranged between the upper chamber and the closable lower chamber. In some embodiments, the pre-selected pressure is no more than the pressure from a volume of liquid which can fill the tubular middle chamber. The advantages of the middle chamber include that it reduces the risk of accidental opening of the non-return valve by providing a receptacle for collection of liquid; and that the presence of a non-return valve in a tundish does not interfere with the operation of the tundish because the risk of spillage of liquid from the tundish is reduced.

In some embodiments, the valve may be a non-return valve, for example a diaphragm check valve, a lift valve or a duck bill valve.

In some embodiments, the valve is a lift valve having a valve stem. In some embodiments, the upper chamber provides one or more ribs to support a valve guide for the valve stem. In some embodiments, the lift valve has a resilient member to bias it into a closed position. In some embodiments, the resilient member is arranged on the lift valve above the valve guide. Provision of a resilient member above the valve guide has the advantage of enabling the valve stem to be self-guiding such that only one valve guide is required.

In some embodiments, the chamber may be provided as a unitary component or single piece. Any or any, any combination or all of the open upper chamber, lower closable chamber, inlet connector, outlet connector and/or one or more arms may be unitarily formed or joined/fused, for example in a manner that prevents separation without breaking the chamber.

According to aspects of the invention, there is provided a shielded connector which comprises a shield and a connector which comprises: a chamber having an open upper chamber and a lower chamber, an inlet connector and an outlet connector formed in a floor of the lower chamber, wherein the inlet connector is supported above the open upper chamber by one or more arms; wherein the upper chamber has an upper chamber floor having an upper chamber outlet, the upper chamber is in fluid communication with the lower chamber by means of the upper chamber outlet; wherein the upper chamber outlet has a non-return valve which is arranged to open at a pre-selected pressure; wherein the lower chamber forms a flow conduit for receiving the valve when it is open; and wherein the shield is shaped to cover the open upper chamber.

According to aspects of the invention, there is also provided a connector which comprises: a chamber having an open upper chamber and a lower chamber, an inlet connector and an outlet connector formed in a floor of the lower chamber, wherein the inlet connector is supported above the open upper chamber by one or more arms; wherein the upper chamber has an upper chamber floor having an upper chamber outlet, the upper chamber is in fluid communication with the lower chamber by means of the upper chamber outlet; wherein the upper chamber outlet has a non-return valve which is arranged to open at a pre-selected pressure;

wherein the lower chamber forms a flow conduit for receiving the valve when it is open.

According to aspects of the invention, there is further provided a shield for a connector having an open upper chamber wherein the shield is shaped to cover the open upper chamber.

According to aspects of the invention, there is also provided a valve assembly for use in sealing an outlet in a connector according to the invention wherein the valve assembly comprises a stem, a biasing member for biasing the valve assembly into a closed position, a valve disc for sealing the outlet, an upper washer and a lower washer wherein the upper and/or lower washer is shaped to support the valve disc such that the valve disc is not distorted in use. In some embodiments, the valve assembly additionally comprises an additional upper washer to provide extra support.

In some embodiments, the upper and/or lower washers of the valve assembly are shaped to support the valve disc such that the valve disc is not compressed in use. It has been found that without the shaped upper and/or lower washer, the valve disc can distort such that the amount of water required to open the valve may change. In some embodiments, the upper and lower washers and the valve disc form central apertures for mounting on the valve stem; wherein one of the upper and lower washers forms a projection around its central aperture and wherein the valve disc aperture is shaped to receive the projection such that valve disc is supported by the upper and lower washers.

The advantages of a connector according to the invention may include that as it is an adapted tundish, it may be compact and space saving such that it can be used in a restricted location such as with an under counter water heater. Its simple construction may enable it to have a rating for temperatures up to 100° C. Furthermore, by providing the lower chamber with a flow conduit for receiving the opened valve, the connector may offer an improved flow rate.

Further advantages may include that the shield may allow the connector to be used to vent a domestic boiler pressure relief valve to a waste water drain by preventing a user from inserting their fingers into the open upper chamber when the connector is in use. This is because the connector needs to be mounted on an outlet from the boiler which is visible but when it is in use, very hot water will be passed through the connector. Therefore the shield can provide protection for a user from that water.

In some embodiments, the shield has a window such that water flow through the upper chamber can be observed. In some embodiments, the shield may be formed partly or wholly from a transparent material.

In some embodiments, the shield has a loose fit on the upper chamber such that the connector provides a vent to atmospheric pressure. In some embodiments, the shield has a tolerance fit (for example, a water tight fit) to the upper chamber wherein the shield has an outlet which provides the shielded connector with a vent to atmospheric pressure. In some embodiments, the connector and/or shield may have a rubber seal to minimise water spillage where the shield fits to the upper chamber.

In some embodiments, the flow conduit is formed by a wall which is spaced from the valve in use so as to provide a volume for liquid flow. In some embodiments, the flow conduit allows the valve to open sufficiently to allow a high flow of water. In some embodiments, a high flow rate of water is a flow rate of over 12 liters per minute, for example a flow rate of from 12 liters per minute, optionally from 15 liters per minute, optionally from 18 liters per minute to 30 liters per minute, optionally to 25 liters per minute, optionally to 18 liters per minute. In some embodiments, the connector according to the invention is suitable for use in venting an unvented boiler or cylinder, particularly a cylinder having high discharge characteristics such as a Megaflo (registered trademark) unvented cylinder or modern design unvented boilers.

some embodiments, the lower chamber forms a first portion and the flow conduit wherein the first portion accommodates the upper chamber outlet and the valve when it is closed. In some embodiments, the first portion has a diameter which is greater than the diameter of the flow conduit such that there is a step between the first portion and the flow conduit. In some embodiments, the first portion has a diameter which is the same as the diameter of the flow conduit. In some embodiments, the floor of the lower chamber is a shelving floor. In some embodiments, the lower chamber floor is arranged between the flow conduit and the outlet connector.

In some embodiments, the pre-selected pressure is a pressure applied by a flow of liquid from the inlet such as may be produced by a pressure and/or temperature relief valve in operation. For example, the pre-selected pressure may be sufficiently high to prevent accidental opening of the non-return valve (for example due to dust or condensation on the valve) but not so high to restrict flow of liquid from the inlet such that liquid overflows from the open upper chamber. A skilled person would be able to determine a suitable pressure.

BRIEF DESCRIPTION OF THE DRAWINGS

The invention will now be illustrated with reference to the following Figures of the accompanying drawings which are not intended to limit the scope of the invention claimed:

DETAILED DESCRIPTION

Figure 1:
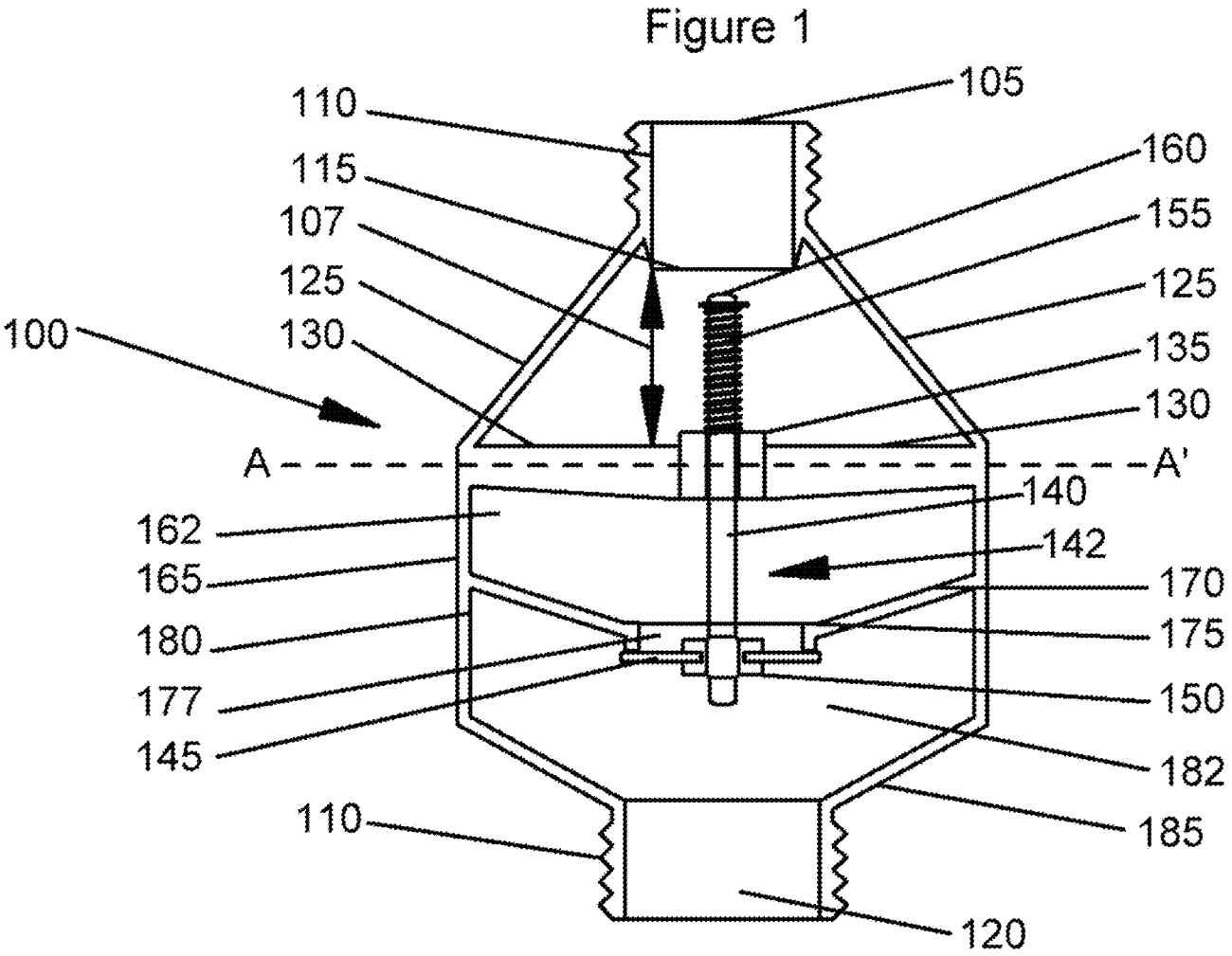
FIG. 1 shows a schematic vertical cross-sectional view of a first embodiment of the invention.
Figure 2:
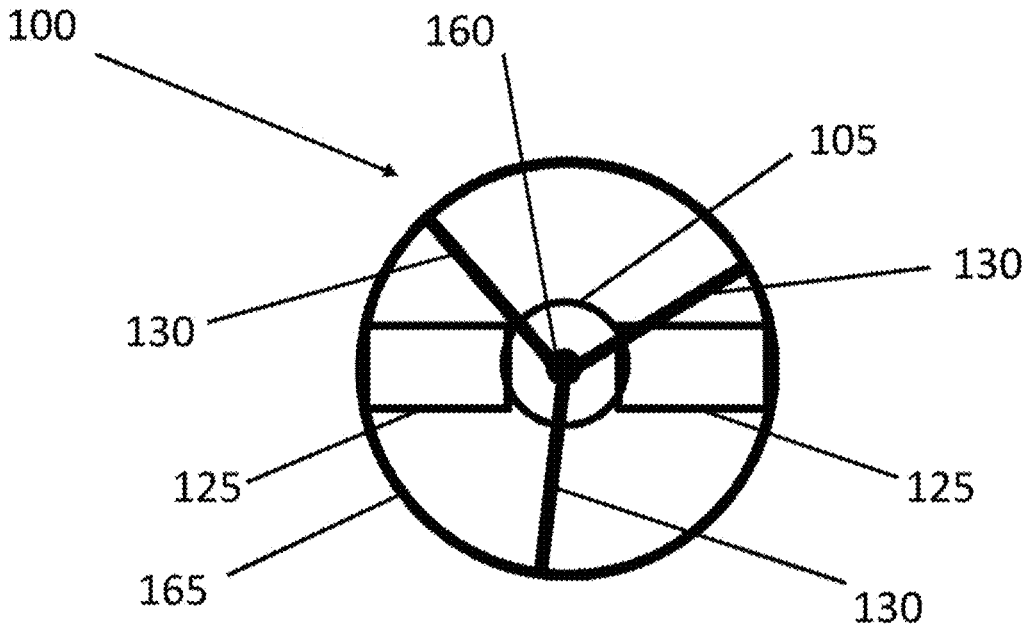
FIG. 2 shows a schematic overhead plan view of the first embodiment of the invention.
Figure 3:
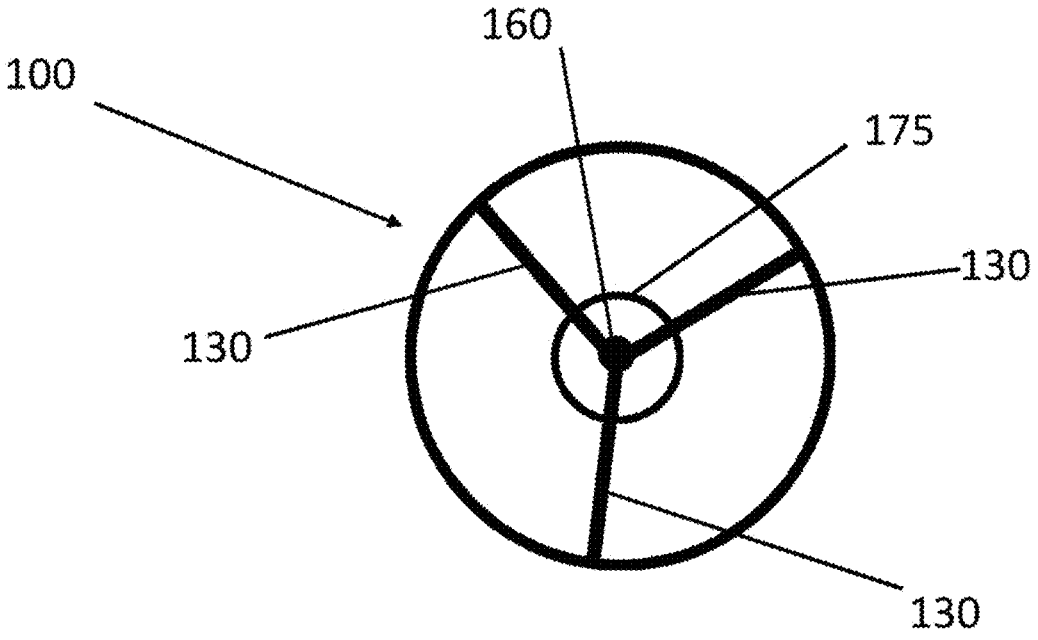
FIG. 3 shows a schematic horizontal cross-sectional view of the first embodiment of the invention taken along line marked A-A' on FIG. 1.

A first embodiment of a connector according to the invention indicated generally at 100 is shown in FIGS. 1, 2 and 3. Connector 100 has an inlet 105, an upper chamber 162, a middle chamber 177, a lower chamber 182 and a lift valve indicated at 142.

Inlet 105 is supported above upper chamber 162 by a pair of diametrically opposed arms 125 such that a vertical gap 107 is formed between the inlet and the upper chamber 162. Inlet 105 has an outer thread 110 for engaging with a tap connector (or other pipe fitting) and forms a tapered beak drip 115 which projects downwards into the vertical gap 107. Arms 125 are arranged so that the vertical gap 107 is of a height sufficient to provide an air gap of type AA which is typically at least about 20 mm.

Upper chamber 162 is shaped by circumferential upper chamber wall 165 and a shelving upper chamber floor 170. Upper chamber 162 has an open mouth for receiving liquid from the inlet. The upper chamber wall 165 supports arms 125. Upper chamber floor 170 forms upper chamber floor opening 175 which is the opening to tubular middle chamber 177 such that upper chamber floor 170 has an inverted truncated conical shape and such that the upper chamber floor 170 has a funnel shape for directing liquid to the upper chamber floor opening 175. Upper chamber wall 165 has three inwardly projecting ribs 130 which support valve guide 135 which is arranged in the centre of the opening to upper chamber 162.

The lift valve 142 has the following components: a valve stem 140, a valve disc 145, a valve disc fixing 150, a valve spring 155 and a valve spring clip 160. The valve stem 140 is arranged to run through valve guide 135. At an upper part of the valve stem 140 above the valve guide 135, valve spring 155 is arranged on the valve stem 140 and secured to an upper end of the valve stem 140 by valve spring clip 160. At a lower end of the valve stem 140, the valve disc 145 is secured by valve disc fixing 150. Valve disc 145 is formed from a resilient material such as a plastics or rubber material, for example EPDM rubber. In an alternative embodiment, the valve spring 155 may be replaced by a suitable resilient member as would be known to a person of skill in the art.

The tubular middle chamber 177 has a lower opening which forms a valve seat for lift valve 142 and which lower opening is normally closed by valve disc 145 which is biased by the valve spring 155 into that position. The valve spring 155 is arranged to open the lift valve 142 at a pre-selected pressure on the valve disc 145. A suitable pre-selected pressure may be that determined by when the tubular middle chamber 177 is full of liquid.

The lower chamber 182 has a ceiling 170,177, a tubular lower chamber wall 180 and a shelving lower chamber floor 185. The ceiling 170,177 of the lower chamber 182 is formed by the upper chamber floor 170 and middle chamber 177 and forms an opening which is normally closed by valve 142. Lower chamber floor 185 shelves to form an opening for outlet 120 such that lower chamber floor 185 has an inverted truncated conical shape and such that the lower chamber floor 185 has a funnel shape for directing liquid to outlet 120. Outlet 120 has a tubular shape and has an outer thread 110 for engaging with a tap connector (or other pipe fitting).

In an alternative embodiment, the diameter of valve disc 145 may be less than that for outlet 120 such that the valve spring 155 and/or valve disc 145 may be replaced by removing valve spring clip 160, allowing the lift valve 142 to drop through outlet 120 and out of the connector 100 so that one or more of the components of lift valve 142 may be replaced.

The connector in any example of the invention may be formed such that the rigid connector body, i.e. excluding the moveable valve components, may be provided as a single piece. The connector body may be formed as a walled structure by moulding. The connector body may be formed as a plurality of sections fused together to provide a single piece. For example, ultrasonic welding or the like may be used to fuse the parts together as a single piece.

Figure 4:
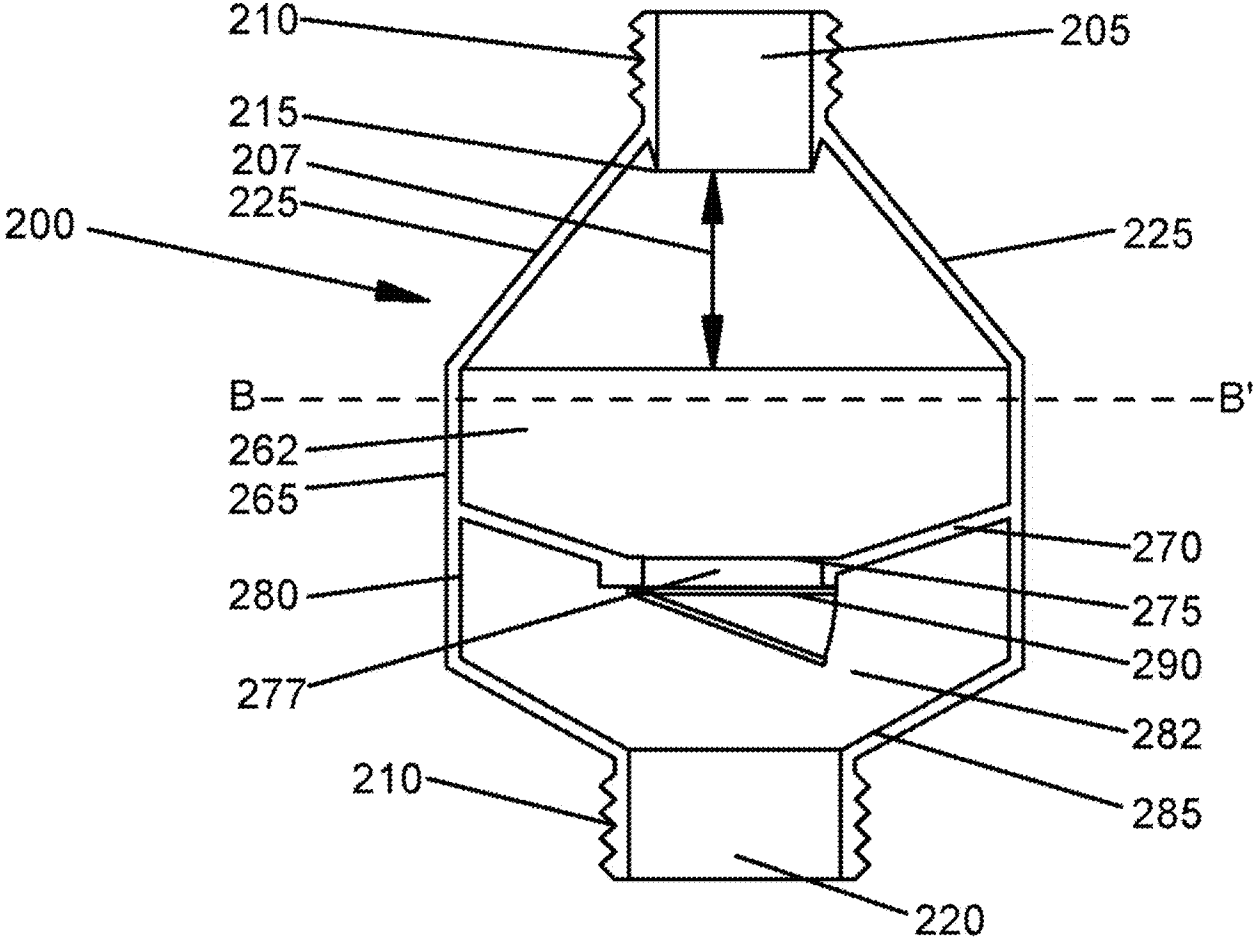
FIG. 4 shows a schematic vertical cross-sectional view of a second embodiment of the invention.
Figure 5:
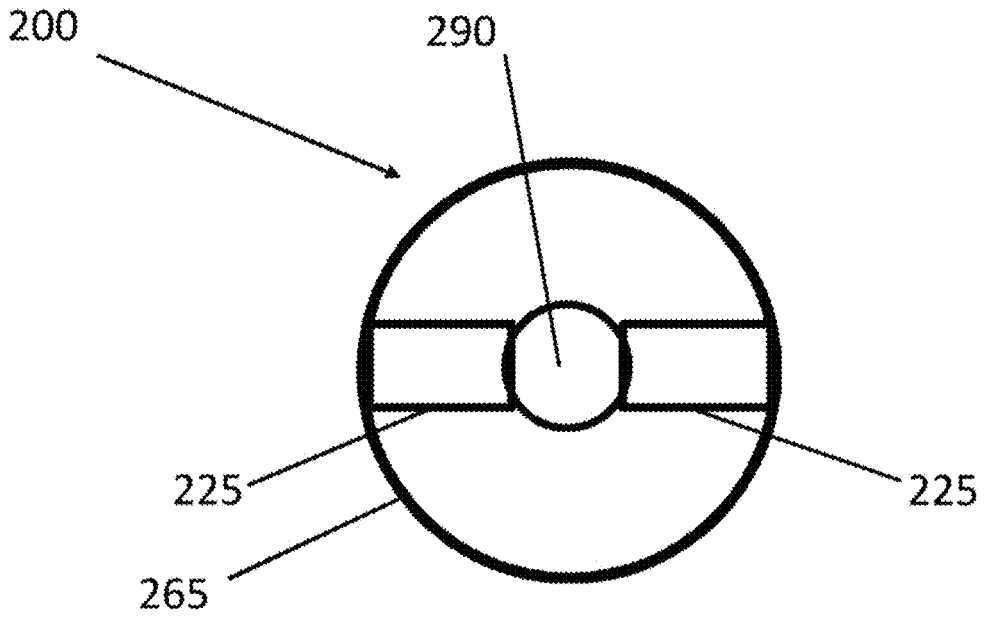
FIG. 5 shows a schematic overhead plan view of the second embodiment of the invention.

A second embodiment of a connector according to the invention indicated generally at 200 is shown in FIGS. 4 and 5. Connector 200 has an inlet 205, an upper chamber 262, a middle chamber 277, a lower chamber 282 and a diaphragm check valve 290. The numbering of the reference numerals for features of the second embodiment corresponds to that for like features of the first embodiment.

Inlet 205 is supported above upper chamber 262 by a pair of diametrically opposed arms 225 such that a vertical gap 207 is formed between the inlet and the upper chamber 262. Inlet 205 has an outer thread 210 for engaging with a tap connector (or other pipe fitting) and forms a tapered beak drip 215 which projects downwards into the vertical gap 207. Arms 225 are arranged so that the vertical gap 207 is of a height sufficient to provide an air gap of type AA which is typically at least about 20 mm.

Upper chamber 262 is shaped by circumferential upper chamber wall 265 and a shelving upper chamber floor 270. Upper chamber 262 has an open mouth for receiving liquid from the inlet. The upper chamber wall 265 supports arms 225. Upper chamber floor 270 forms upper chamber floor opening 275 which is the opening to tubular middle chamber 277 such that upper chamber floor 270 has an inverted truncated conical shape and such that the upper chamber floor 270 has a funnel shape for directing liquid to the upper chamber floor opening 275. The features of the upper part of connector 200 are shown in the overhead plan view depicted in FIG. 5.

Diaphragm check valve 290 is formed from a resilient material and is shaped to be biased into a closed position. Diaphragm check valve 290 is shown in an open position by a partially occluded form shown on FIG. 4. The tubular middle chamber 277 has a lower opening which forms a valve seat for lift valve 142 and which lower opening is normally closed by the diaphragm check valve 290. The diaphragm check valve 290 is attached the lower opening of middle chamber 277. The diaphragm check valve 290 is arranged to open at a pre-selected pressure. A suitable pre-selected pressure may be that determined by when the tubular middle chamber 277 is full of liquid.

The lower chamber 282 has a ceiling 270,277, a tubular lower chamber wall 280 and a shelving lower chamber floor 285. The ceiling 270,277 of the lower chamber 282 is formed by the upper chamber floor 270 and middle chamber 277 and forms an opening which is normally closed by diaphragm check valve 290. Lower chamber floor 285 shelves to form an opening for outlet 220 such that lower chamber floor 285 has an inverted truncated conical shape and such that the lower chamber floor 285 has a funnel shape for directing liquid to outlet 220. Outlet 220 has a tubular shape and has an outer thread 210 for engaging with a tap connector (or other pipe fitting).

Figure 6:
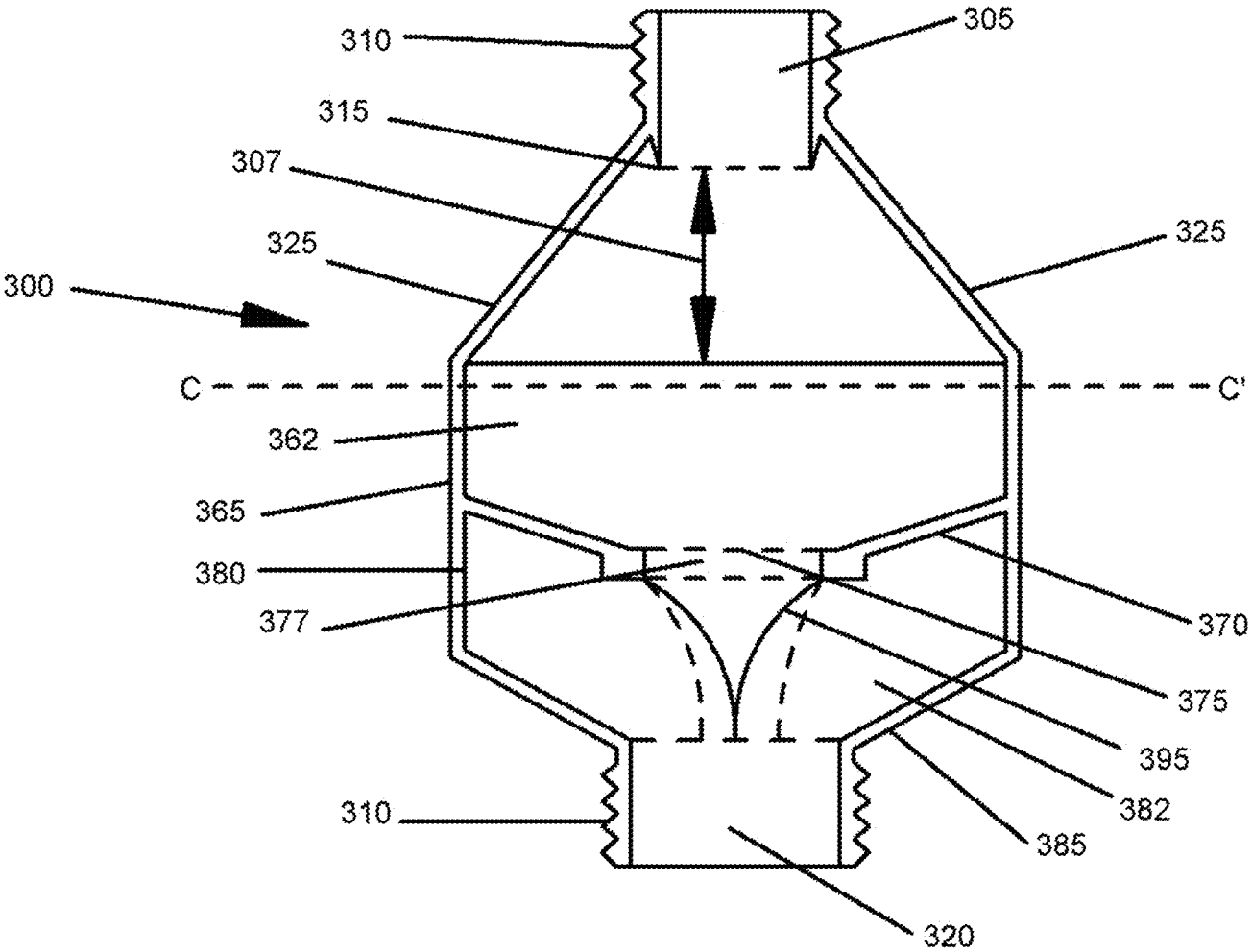
FIG. 6 shows a schematic vertical cross-sectional view of a third embodiment of the invention.

A third embodiment of a connector according to the invention indicated generally at 300 is shown in FIG. 6.

Connector 300 has an inlet 305, an upper chamber 362, a middle chamber 377, a lower chamber 382 and a duck bill valve 395. The numbering of the reference numerals for features of the third embodiment corresponds to that for like features of the first and second embodiments.

Inlet 305 is supported above upper chamber 362 by a pair of diametrically opposed arms 325 such that a vertical gap 307 is formed between the inlet and the upper chamber 362. Inlet 305 has an outer thread 310 for engaging with a tap connector (or other pipe fitting) and forms a tapered beak drip 315 which projects downwards into the vertical gap 307. Arms 325 are arranged so that the vertical gap 307 is of a height sufficient to provide an air gap of type AA which is typically at least about 20 mm.

Figure 7:
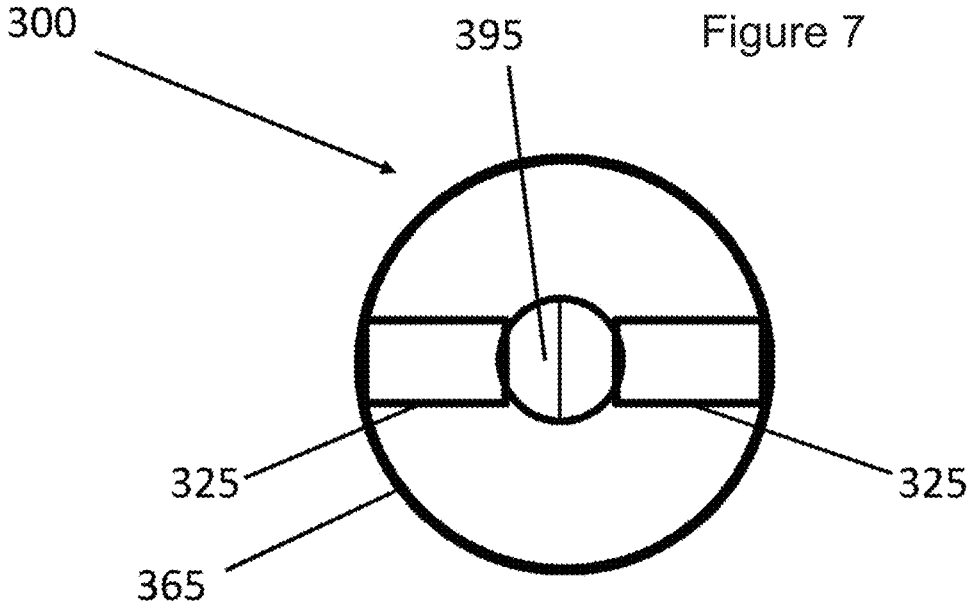
FIG. 7 shows a schematic overhead plan view of the second embodiment of the invention

Upper chamber 362 is shaped by circumferential upper chamber wall 365 and a shelving upper chamber floor 370. Upper chamber 362 has an open mouth for receiving liquid from the inlet. The upper chamber wall 365 supports arms 325. Upper chamber floor 370 forms upper chamber floor opening 375 which is the opening to tubular middle chamber 377 such that upper chamber floor 370 has an inverted truncated conical shape and such that the upper chamber floor 370 has a funnel shape for directing liquid to the upper chamber floor opening 375. The features of the upper part of connector 200 are shown in the overhead plan view depicted in FIG. 7.

Duck bill valve 395 is formed from a resilient material biased to a closed position. Duck bill valve 395 is shown in an open position by the partially occluded form shown on FIG. 6. Duck bill valve comprises two downwardly extending, opposed flexible impervious wall members of complementary shapes disposed face to face in surface contact so that there is no through passage between them in their normal state and where they are resiliently urged into the normal state.

The tubular middle chamber 377 has a lower opening on which the wall members of the duck bill valve 395 are mounted and which lower opening is normally closed by the duck bill valve 395. Liquid at a pre-selected pressure will force the wall members of the duck bill valve 395 apart to permit flow between them from the middle chamber 377 into the lower chamber 382. A suitable pre-selected pressure may be that determined by when the tubular middle chamber 377 is full of liquid. The duck bill valve 395 prevents liquid flow in the opposite direction by the close surface contact between its wall members.

The lower chamber 382 has a ceiling 370,377, a tubular lower chamber wall 380 and a shelving lower chamber floor 385. The ceiling 370,377 of the lower chamber 382 is formed by the upper chamber floor 370 and middle chamber 377 and forms an opening which is normally closed by diaphragm check valve 390. Lower chamber floor 385 shelves to form an opening for outlet 320 such that lower chamber floor 385 has an inverted truncated conical shape and such that the lower chamber floor 385 has a funnel shape for directing liquid to outlet 320. Outlet 320 has a tubular shape and has an outer thread 310 for engaging with a tap connector (or other pipe fitting).

Figure 8:
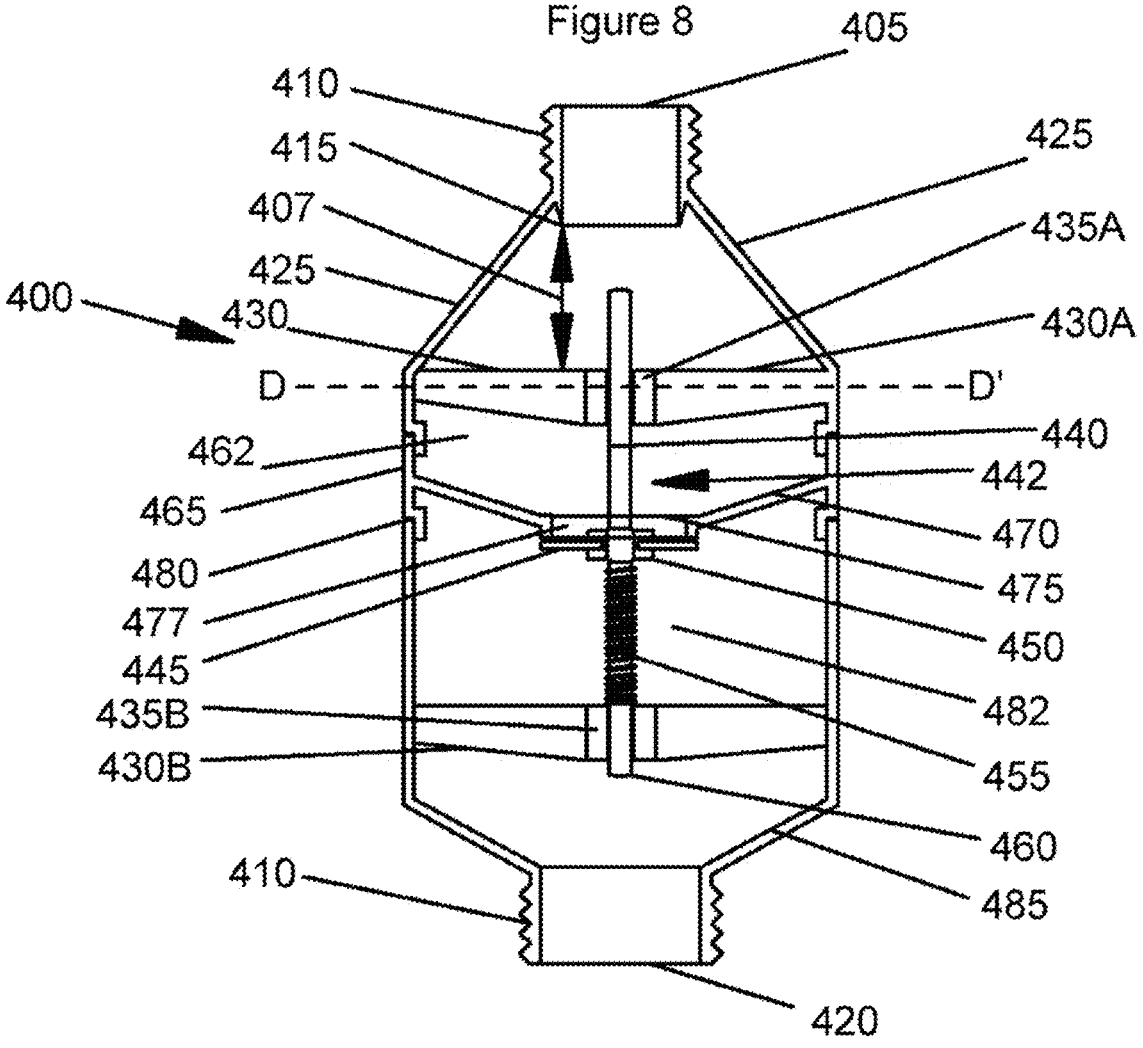
FIG. 8 shows a schematic vertical cross-sectional view of a third embodiment of the invention.

A fourth embodiment of a connector according to the invention indicated generally at 400 is shown in FIG. 8. Connector 400 has an inlet 405, an upper chamber 462, a middle chamber 477, a lower chamber 482 and a lift valve indicated at 442.

Inlet 405 is supported above upper chamber 462 by a pair of diametrically opposed arms 425 such that a vertical gap 407 is formed between the inlet and the upper chamber 462. Inlet 405 has an outer thread 410 for engaging with a tap connector (or other pipe fitting) and forms a tapered beak drip 415 which projects downwards into the vertical gap 407. Arms 425 are arranged so that the vertical gap 407 is of a height sufficient to provide an air gap of type AA which is typically at least about 20 mm.

Upper chamber 462 is shaped by circumferential upper chamber wall 465 and a shelving upper chamber floor 470. Upper chamber 462 has an open mouth for receiving liquid from the inlet. The upper chamber wall 465 supports arms 425. Upper chamber floor 470 forms upper chamber floor opening 475 which is the opening to tubular middle chamber 477 such that upper chamber floor 470 has an inverted truncated conical shape and such that the upper chamber floor 470 has a funnel shape for directing liquid to the upper chamber floor opening 475. Upper chamber wall 465 has three inwardly projecting ribs 430A which support valve guide 435A which is arranged in the centre of the opening to upper chamber 462.

The lower chamber 482 has a ceiling 470,477, a tubular lower chamber wall 480 and a shelving lower chamber floor 485. The ceiling 470,477 of the lower chamber 482 is formed by the upper chamber floor 470 and middle chamber 477 and forms an opening which is normally closed by valve 442. Lower chamber floor 485 shelves to form an opening for outlet 420 such that lower chamber floor 485 has an inverted truncated conical shape and such that the lower chamber floor 485 has a funnel shape for directing liquid to outlet 420. Outlet 420 has a tubular shape and has an outer thread 410 for engaging with a tap connector (or other pipe fitting). Lower chamber wall 480 has three inwardly projecting ribs 430B which support valve guide 435B which is arranged in the centre of lower chamber 482.

The lift valve 442 has the following components: a valve stem 440, a valve disc 445, a valve disc fixing 450, a valve spring 455 and a valve spring clip 460. The valve stem 440 is arranged to run through valve guides 435A,435B. At a lower part of the valve stem 440 above the valve guide 435B and below valve disc 445, valve spring 455 is arranged on the valve stem 440 and secured to a lower end of the valve stem 440 by valve spring clip 460. In the middle of the valve stem 440, the valve disc 445 is secured by valve disc fixing 450. Valve disc 445 is formed from a resilient material such as a plastics or rubber material, for example EPDM rubber. In an alternative embodiment, the valve spring 455 may be replaced by a suitable resilient member as would be known to a person of skill in the art.

The tubular middle chamber 477 has a lower opening which forms a valve seat for lift valve 442 and which lower opening is normally closed by valve disc 445 which is biased by the valve spring 455 into that position. The valve spring 455 is arranged to open the lift valve 442 at a pre-selected pressure on the valve disc 445. A suitable pre-selected pressure may be that determined by when the tubular middle chamber 477 is full of liquid.

In an alternative embodiment, the three inwardly projecting ribs 430A and valve guide 435A may be removed such that the valve stem 440 is only supported by valve guide 435B.

Figure 9:
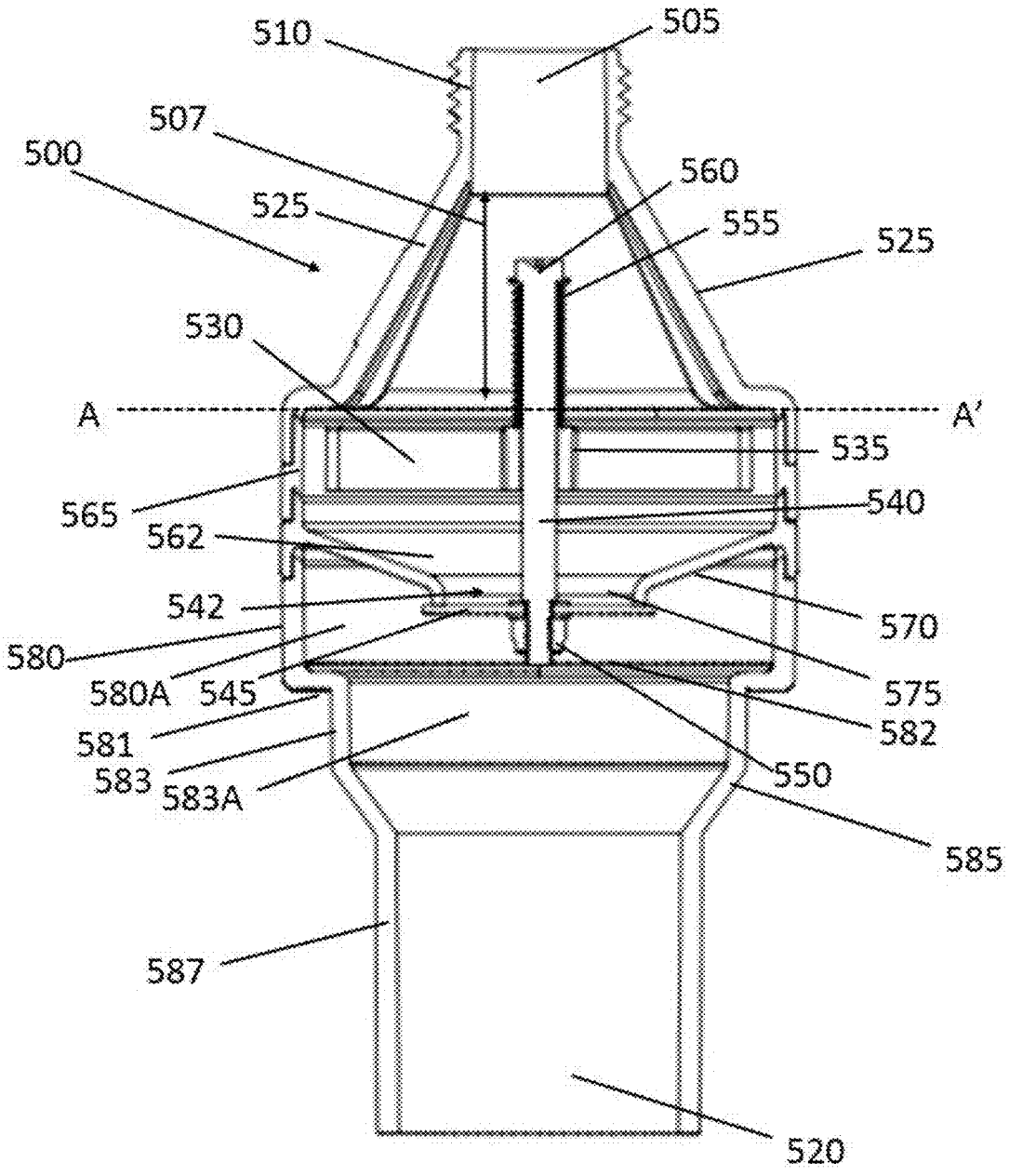
FIG. 9 shows a schematic vertical cross-sectional view of a further embodiment of the invention.

Another embodiment of a connector according to the invention indicated generally at 100 is shown in FIG. 9. Connector 500 has an inlet 505, an upper chamber 562, a lower chamber 582 and a lift valve indicated at 542.

Inlet 505 is supported above upper chamber 562 by a pair of diametrically opposed arms 525 such that a vertical gap 507 is formed between the inlet and the upper chamber 562. Inlet 505 has an outer thread 510 for engaging with a tap connector (or other pipe fitting) and forms a tapered beak drip 515 which projects downwards into the vertical gap 507. Arms 525 are arranged so that horizontal gaps between the arms 525 and the vertical gap 507 are sufficient to provide an air break to drain, typical for a standard tundish.

Upper chamber 562 is shaped by circumferential upper chamber wall 565 and a shelving upper chamber floor 570. Upper chamber 562 has an open mouth for receiving liquid from the inlet. The upper chamber wall 565 supports arms 525. Upper chamber floor 570 forms upper chamber floor outlet 575 such that upper chamber floor 570 has an inverted truncated conical shape and such that the upper chamber floor 570 has a funnel shape for directing liquid to the upper chamber floor outlet 575. Upper chamber wall 565 has three inwardly projecting ribs 530 which support valve guide 535 which is arranged in the centre of the opening to upper chamber 562.

The lift valve 542 has the following components: a valve stem 540, a valve disc 545, a valve disc fixing 550, a valve spring 555 and a valve spring clip 560. The valve stem 540 is arranged to run through valve guide 535. At an upper part of the valve stem 540 above the valve guide 535, valve spring 555 is arranged on the valve stem 540 and secured to an upper end of the valve stem 540 by valve spring clip 560. At a lower end of the valve stem 540, the valve disc 545 is secured by valve disc fixing 550. Valve disc 545 is formed from a resilient material such as a plastics or rubber material, for example EPDM rubber. In an alternative embodiment, the valve spring 555 may be replaced by a suitable resilient member as would be known to a person of skill in the art.

The upper chamber floor outlet 575 forms a valve seat for lift valve 542 and which outlet 575 is normally closed by valve disc 545 which is biased by the valve spring 555 into that position. The valve spring 555 is arranged to open the lift valve 542 at a pre-selected pressure on the valve disc 545.

The lower chamber 582 has a ceiling 570, a first tubular lower chamber wall 580 forming a first lower chamber portion 580A, a horizontal step 581, a second lower chamber wall 583 forming a lower chamber flow conduit 583A, and a shelving lower chamber floor 585. The ceiling 570 of the lower chamber 582 is formed by the upper chamber floor 570. The first lower chamber portion 580A provides a cylindrical volume which receives or accommodates the upper chamber floor 570, upper chamber outlet 575 and valve 542 in its closed position, particularly valve disc 545 and valve disc fixing 550. In an alternative embodiment, instead of being cylindrical, first portion 580A may have a polygonal cross-sectional shape. The lower chamber flow conduit 583A provides a cylindrical volume 583A for receiving valve 542 in its open position, particularly valve disc 545, valve disc fixing 550 and part of valve stem 540. In an alternative embodiment, instead of being cylindrical, flow conduit 583A may have a polygonal cross-sectional shape. Lower chamber floor 585 shelves to form an opening for outlet 520 such that lower chamber floor 585 has an inverted truncated conical shape and such that the lower chamber floor 185 has a funnel shape for directing liquid to outlet 5120. Outlet 520 has a tubular shape, a diameter suitable for attachment to a waste pipe and has a smooth outer surface suitable for engaging with a push fit or universal fitting (not shown).

The first lower chamber portion 580A provides a volume for receiving a liquid such as water discharged through the upper chamber floor outlet 575 when lift valve 542 is opened. Lower chamber flow conduit 583A has a smaller diameter than the first portion 580A because of step 581. In an alternative embodiment, the diameter of the flow conduit 583A may be the same as the diameter of the first portion 580A such that there is no step 581. The diameter of the flow conduit 583A is substantially greater than the diameter of the valve disc 545, for example 50% to 80% greater, particularly 66% greater such that a volume for liquid flow is provided between the lift valve 542 and the second lower chamber wall 583. When lift valve 542 is opened, flow conduit 183A receives lift valve 542 such that there is free flow of water around lift valve 542 within second lower chamber wall 583. If lower chamber 582 had the typical shape of a tundish, there would be no flow conduit 583A below first portion 580A but instead there would be a shelving floor. The insertion of the flow conduit 583A has surprisingly been found to increase flow rate of liquids through the connector 500 by 50% compared to the connector of FIG. 1 but with only a 20% increase in the overall length of the connector (the diameter of the connector 500 being the same as the diameter of the connector 100.

In an alternative embodiment, the diameter of valve disc 545 may be less than that for outlet 520 such that the valve spring 555 and/or valve disc 545 may be replaced by removing valve spring clip 560, allowing the lift valve 542 to drop through outlet 520 and out of the connector 500 so that one or more of the components of lift valve 542 may be replaced.

The increase in overall length of the connector 500 provides the connector with a push fit facility. Without the push fit connection, the length of the connector could be substantially the same as that disclosed in the previous embodiments.

Figure 10:
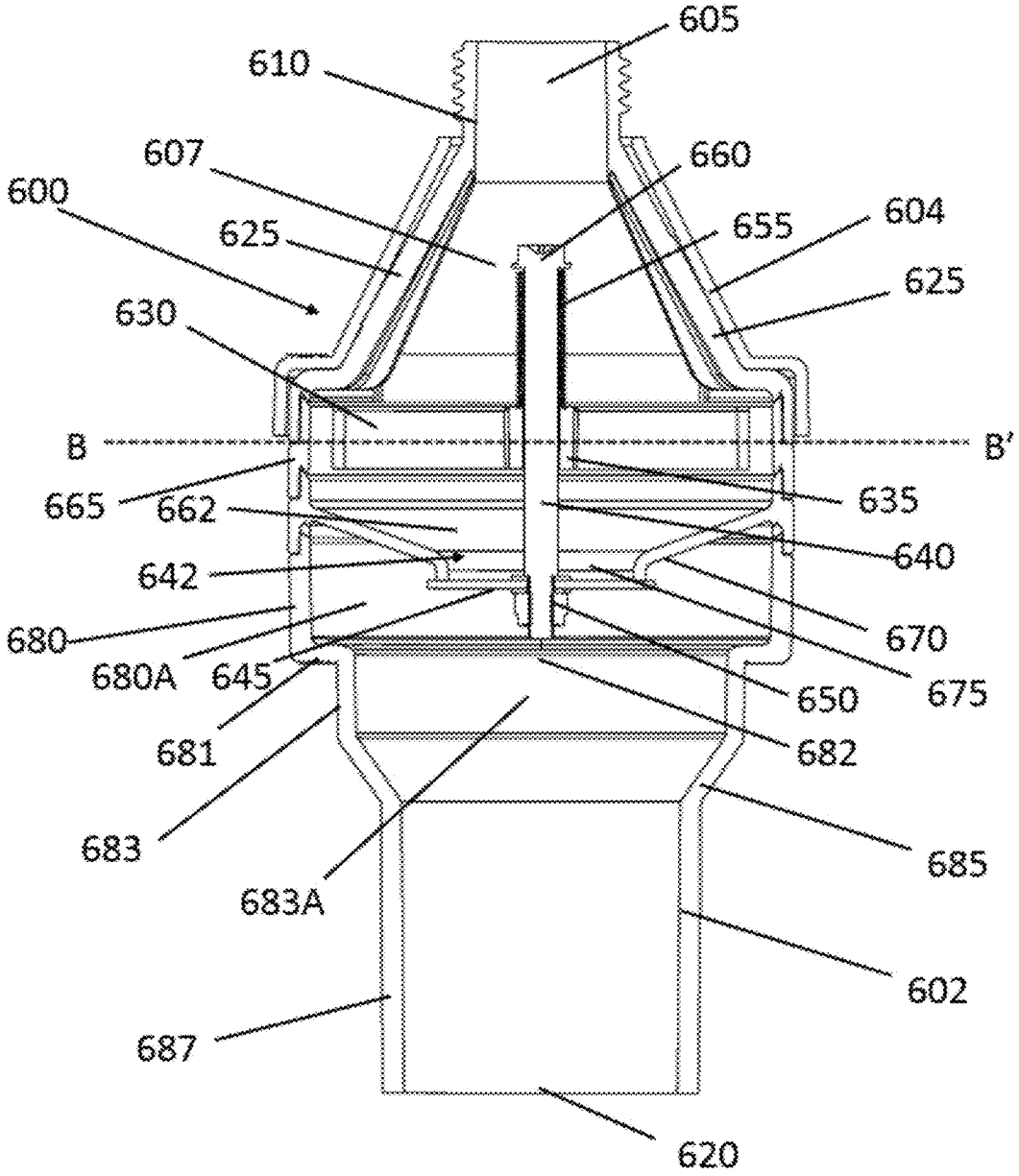
FIG. 10 shows a schematic vertical cross-sectional view of a further embodiment of the shielded connector according to the invention.
Figure 11:
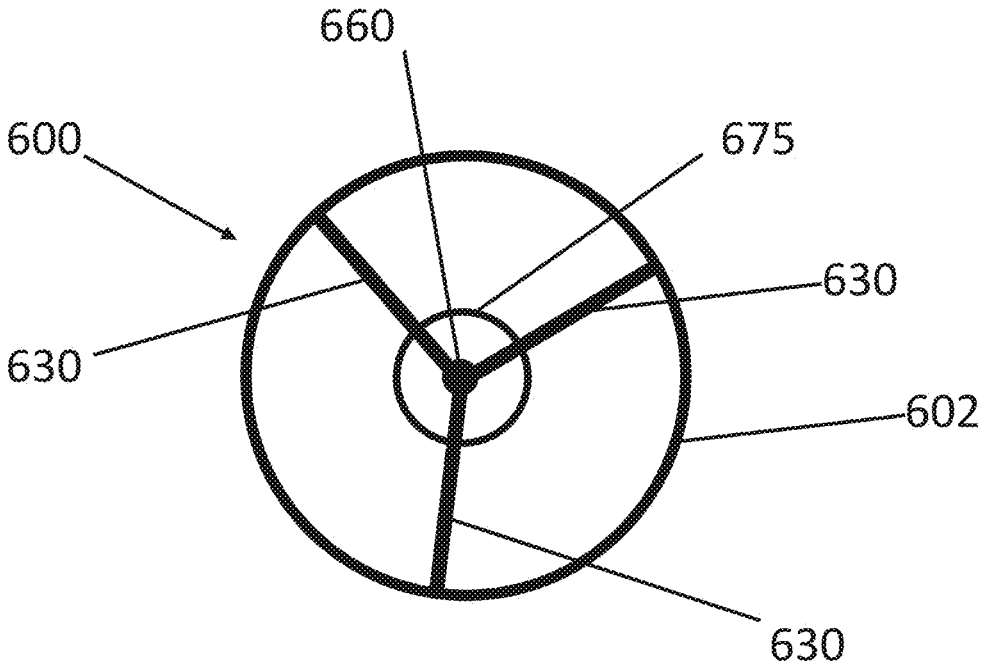
FIG. 11 shows a schematic horizontal cross-sectional view of the embodiment of the invention taken along line marked B-B' on FIG. 10.
Figure 12:
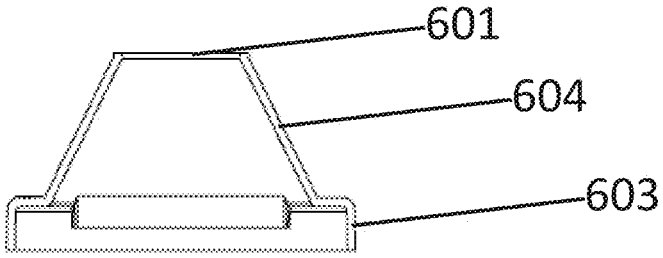
FIG. 12 shows a cross-sectional view of a shield according to the invention.

An embodiment of a shielded connector according to the invention is shown in FIGS. 10, 11 and 12. The shielded connector 600 comprises a connector substantially as described in relation to FIG. 5. A corresponding sequence of reference numerals for connector 600 have been provided in FIG. 10 and like features will not be described again.

As shown in FIGS. 10 and 12, the shielded connector 600 comprises a removable shield member 604 seated atop the connector body. The shield 604 has a frustroconical shape having an upper opening 601 which is shaped to fit over inlet 605 and a skirt 603 which is shaped to cover 662 and has a length approximately the same as the length of arms 625. The shield thus covers the arms 625 and the air gap between the arms so as to block access thereto, whilst preserving the internal spacing required for operation of the device.

Figure 13:
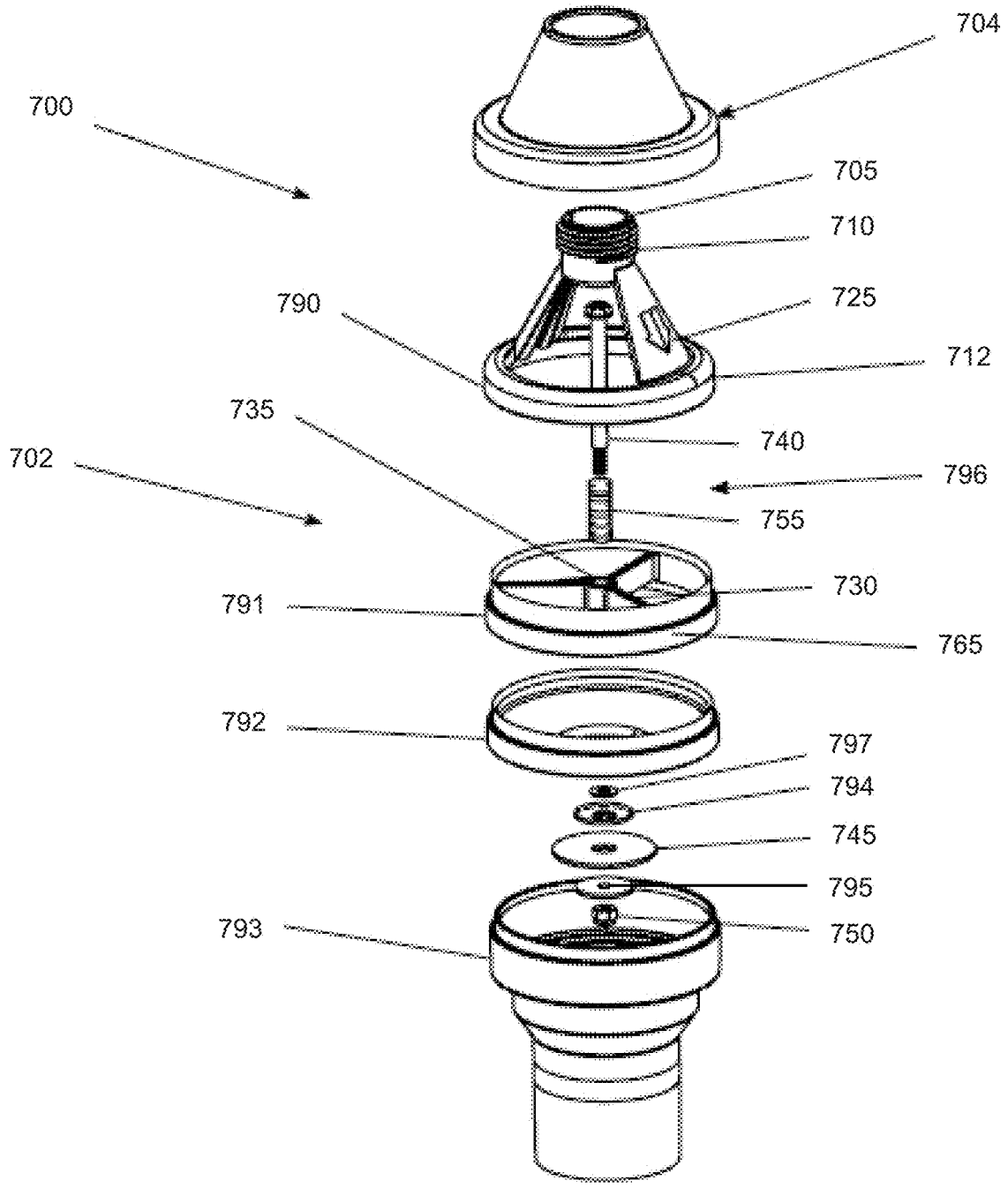
FIG. 13 shows a schematic perspective view of the parts from which a shielded connector according to an example of the invention may be constructed.

A further embodiment of the shielded connector according to the invention is indicated generally at 700 in FIG. 13. The shielded connector 700 has a shield 704 and a connector 702. FIG. 13 illustrates the five parts from which the connector 702 is constructed. The five parts are the upper chamber head 790, the upper chamber body 791, the upper chamber foot 792, the lower chamber body 793 and the valve assembly 796. The four parts 790,791,792,793, may be joined together by ultrasonic welding or, in an alternate embodiment, by an equivalent technique as might be known to a person of skill in the art. The upper chamber head 790 comprises two circular plastic rings 710,712 which are joined by arms 725. Upper ring 710 is smaller in diameter than lower ring 712 and forms inlet 705 such that upper ring 710 is arranged concentrically above lower ring 712 by arms 725. Upper chamber body 791 comprises an outer circular plastic ring formed by upper chamber wall 765, inwardly projecting ribs 730 mounted on an inner surface of upper chamber wall 765 and valve guide 735 which is supported by ribs 730. The upper chamber foot 792 provides the upper chamber floor 770 and upper chamber floor outlet 775. The lower chamber body 793 provides the lower chamber 782 as described above for the second embodiment.

Figure 14:
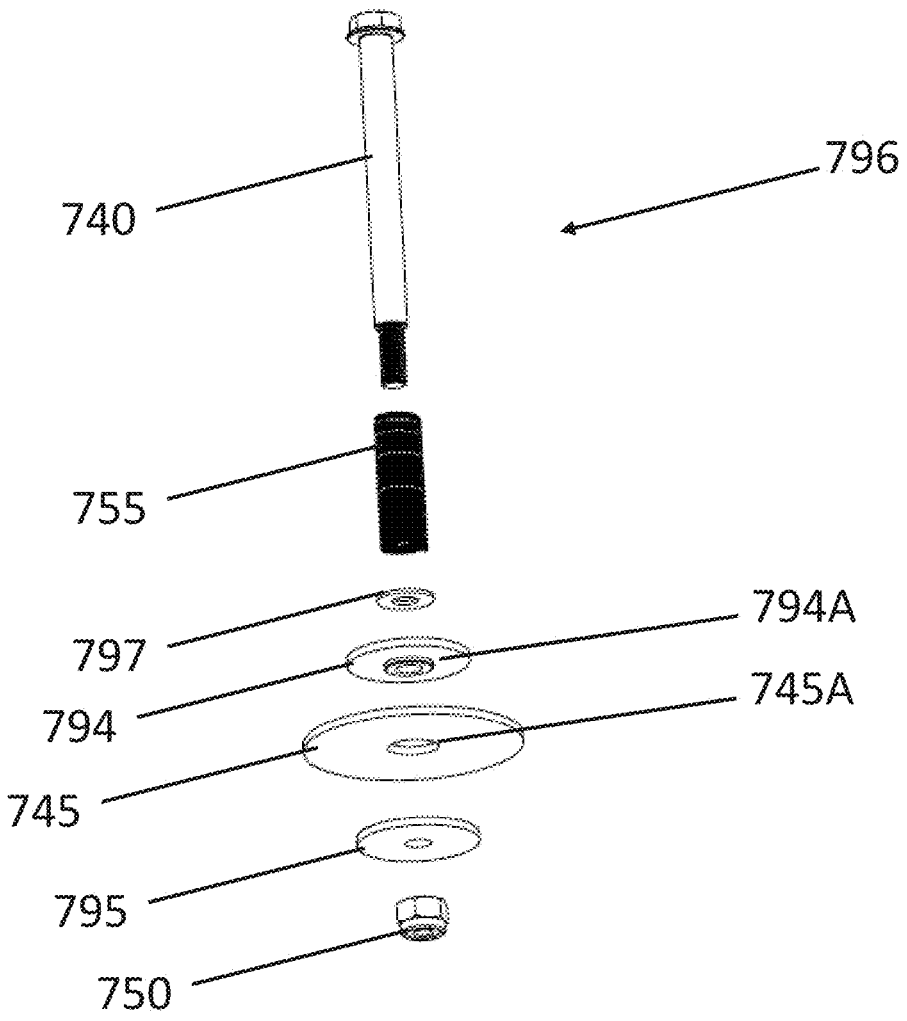
FIG. 14 shows a schematic perspective view of a valve assembly for use in the invention.

The valve assembly 796 provides the lift valve 742. Valve assembly 796 is shown in more detail in FIG. 14. Valve assembly 796 comprises a valve stem 740 in the form of a shoulder bolt, a valve disc 745, a valve disc fixing 750 in the form of a self-locking nut, a valve spring 755, a first upper washer 797, a second upper washer 794 and a lower washer 795. The second upper washer 794 has an inverted top hat shape forming a lower projection 794A. Valve disc 745 has a central aperture 745A which is shaped to receive not only the shaft of shoulder bolt 740 but also lower projection 794A such that in use, valve disc 745 is supported by second upper washer 794 and lower washer 795 such that the shape of valve disc 745 is not distorted when valve disc fixing 750 is tightened on shoulder bolt 740. Additionally first upper washer 797 provides additional support by preventing second upper washer 794 from being pushed up past the shoulder of the threaded portion of the valve stem 740. The inclusion of separate first upper washer 797 provides a washer function on an upper side of valve disc 745, allowing second upper washer 794 to provide only a supporting function for the valve disc 745. In an alternative embodiment, the first and second upper washers 794,797 might be arranged below the valve disc 745.

Any of the alternative valve types of FIGS. 4-8 may be substituted for the valves shown in FIGS. 9-14.

Any of the above described embodiments of the invention may be provided with a shield of the kind described above in relation to FIGS. 11-14.

The invention claimed is:

1. A connector comprising an inlet connector, a chamber having an open upper chamber and a lower closable chamber, and an outlet connector formed in a floor of the lower chamber wherein the inlet connector is supported above the open upper chamber by a plurality of horizontally spaced arms such that a vertical gap is formed between an inlet and the upper chamber, the arms being arranged so that the horizontal spacing between the arms and the vertical gap are sufficient to provide an air break to drain, and wherein the lower chamber is closable by a non-return valve which is arranged to open at a pre-selected pressure.

2. The connector as defined in claim 1 wherein the chamber has a tubular middle chamber arranged between the upper chamber and the closable lower chamber.

3. The connector as defined in claim 2 wherein the pre-selected pressure is no more than the pressure from a volume of liquid which can fill the tubular middle chamber.

4. The connector as defined in claim 1 wherein the non-return valve is a diaphragm check valve, a lift valve or a duck bill valve.

5. The connector as defined in claim 4 wherein the valve is a lift valve having a valve stem and the upper chamber provides one or more ribs to support a valve guide for the valve stem.

6. The connector as defined in claim 5 wherein the upper chamber has an upper chamber wall and an upper chamber floor and the upper chamber wall provides the one or more ribs.

7. The connector as defined in claim 5 wherein the lift valve has a resilient member to bias the lift valve into a closed position and the resilient member is arranged on the lift valve above the valve guide.

8. The connector as defined in claim 7 wherein the resilient member is secured on the lift valve by a removable clip; the lift valve having a valve disc with a diameter less than the diameter of the outlet such that one or more components of the lift valve may be replaced.

9. The connector as defined in claim 1 further comprising a shield, wherein the shield is shaped to cover the open upper chamber.

10. The connector as defined in claim 9 wherein the shield has a window such that water flow through the upper chamber can be observed.

11. The connector as defined in claim 9 wherein the shield comprises, or is formed from, a transparent material.

12. The connector as defined in claim 9 wherein the shield has a loose fit on the upper chamber such that the connector provides a vent to atmospheric pressure.

13. The shielded connector as defined in claim 9 wherein the shield has a tolerance fit to the upper chamber; and wherein the shield has an outlet which provides the shielded connector with a vent to atmospheric pressure.

14. A connector which comprises:

a. a chamber having an open upper chamber and a lower chamber, b. an inlet connector and c. an outlet connector formed in a floor of the lower chamber wherein the inlet connector is supported above the open upper chamber by a plurality of horizontally spaced arms, such that a vertical gap is formed between an inlet and the upper chamber, the arms being arranged so that the horizontal spacing between the arms and the vertical gap are sufficient to provide an air break to drain;

wherein the upper chamber has an upper chamber floor having an upper chamber outlet;

wherein the upper chamber is in fluid communication with the lower chamber by means of the upper chamber outlet;

wherein the upper chamber outlet has a non-return valve which is arranged to open at a pre-selected pressure; and wherein the lower chamber forms a flow conduit for receiving the valve when the lower chamber is open.

15. The connector as defined in claim 14 wherein the valve is a lift valve having a valve stem, and wherein the upper chamber provides one or more ribs to support a valve guide for the valve stem, the lift valve having a resilient member to bias the lift valve into a closed position.

16. The connector as defined in claim 14 wherein the flow conduit is formed by a wall which is spaced from the valve in use so as to provide a volume for liquid flow and wherein the flow conduit allows clearance for the valve to open sufficiently to allow a high flow of water of over 12 liters per minute.

17. The connector as defined in claim 14 wherein the valve has a valve disc and where the diameter of the flow conduit is 50% to 80% greater than the diameter of the valve disc.

18. The connector as defined in claim 14 wherein the lower chamber forms a first portion for accommodating the upper chamber outlet and the valve when it is closed and the flow conduit, and wherein the first portion has a diameter which is either the same as the diameter of the flow conduit or else the first portion has a diameter which is greater than the diameter of the flow conduit such that there is a step between the first portion and the flow conduit.

19. The connector as defined in claim 14 wherein the floor of the lower chamber is a shelving floor arranged between the flow conduit and the outlet connector.

20. A valve assembly for use in sealing an outlet in the connector as defined in claim 14 wherein the valve assembly comprises a stem, a biasing member for biasing the valve assembly into a closed position, a valve disc for sealing the outlet, an upper washer and a lower washer wherein the upper and lower washers support the valve disc such that the valve disc does not distort in use.

21. The valve assembly as defined in claim 20 wherein the upper and lower washers of the valve assembly support the valve disc such that the valve disc does not contact the valve stem, the upper and lower washers and the valve disc forming central apertures for mounting on the valve stem; wherein one of the upper and lower washers forms a projection around its central aperture and the valve disc aperture is shaped to receive the projection such that valve disc is supported by the upper and lower washers.

22. A connector comprising an inlet connector, a chamber having an open upper chamber and a lower closable chamber, and an outlet connector formed in a floor of the lower chamber wherein the inlet connector is supported above the open upper chamber by one or more arms and wherein the lower chamber is closable by a non-return valve which is arranged to open at a pre-selected pressure, the connector further comprising a shield, wherein the shield is shaped to loosely fit the open upper chamber and thereby cover the open upper chamber.

* * * * *